US007498499B2

(12) United States Patent
Sharp

(10) Patent No.: US 7,498,499 B2
(45) Date of Patent: Mar. 3, 2009

(54) VISCOELASTIC POLYMER DAMPING FOR PERCUSSION INSTRUMENTS

(76) Inventor: Jeffrey J. Sharp, 205 Quigley Drive, Cochrane, Alberta (CA) T4C 1S7

( * ) Notice: Subject to any disclaimer, the term of this patent is extended or adjusted under 35 U.S.C. 154(b) by 56 days.

(21) Appl. No.: 11/524,612

(22) Filed: Sep. 21, 2006

(65) Prior Publication Data

US 2007/0068364 A1 Mar. 29, 2007

Related U.S. Application Data

(60) Provisional application No. 60/719,648, filed on Sep. 22, 2005.

(51) Int. Cl.
*G10D 13/02* (2006.01)

(52) U.S. Cl. ..... 84/411 R

(58) Field of Classification Search ..... 84/411 R, 84/411 M

See application file for complete search history.

(56) References Cited

U.S. PATENT DOCUMENTS

| | | | | |
|---|---|---|---|---|
| 4,102,235 | A | 7/1978 | Le Masters | |
| 4,154,137 | A | 5/1979 | Kobayashi | |
| 4,226,156 | A | 10/1980 | Hyakutake | |
| 4,325,280 | A * | 4/1982 | Hardy | 84/411 M |
| 4,338,850 | A | 7/1982 | Payson | |
| 4,581,973 | A | 4/1986 | Hoshino | |
| 4,745,839 | A | 5/1988 | Peraino | |
| 4,776,254 | A | 10/1988 | Cruz | |
| 4,989,870 | A * | 2/1991 | Janes | 473/537 |
| 5,637,819 | A | 6/1997 | Rogers | |
| 5,833,320 | A | 11/1998 | Kaneko et al. | |
| 5,959,227 | A | 9/1999 | Shapiro | |
| 6,696,630 | B2 * | 2/2004 | Gatzen | 84/411 M |
| 6,720,491 | B1 | 4/2004 | Kroncke | |
| 2006/0040096 | A1 * | 2/2006 | Eadara et al. | 428/212 |

OTHER PUBLICATIONS

Viscoelastic Damping Polymer 110, Technical Data, Apr. 2003, pp. 1-8, 3M™, St. Paul, MN.

MUFFELT™, Slug Felt Products, webpage http://www.slugdrums.com/SlugWebPages/Felproducts.html, Jul. 25, 2005, 1 page.

Evans Min-EMAD Tom and Snare Dampers, webpage http://www.evansdrumheads.com/EVProducts.aspx?ID=5&CLASS=safe, Jul. 25, 2005, 1 page RTOM—Moongel Damper Pads, webpage http://www.rtom.com/damperpads.html, Jul. 27, 2005, 1 page.

Pro-Mark Drumsticks DrumGum™, webpage http://www.promark-stix.com/news/news.cfm?news_ id=df6306c8-b. . , Jul. 27, 2005, 1 page.

Variable Hardness Polyurethane, webpage http://www.crosslinktech.com/variableratiourethane.htm, Nov. 5, 2004, pp. 1-4.

* cited by examiner

*Primary Examiner*—Kimberly R Lockett
(74) *Attorney, Agent, or Firm*—Cesari and McKenna LLP

(57) ABSTRACT

A system and method are provided for damping a vibrating surface, such as a drumhead, of a percussion instrument by attaching a patch made from a viscoelastic urethane polymer to an exterior face of the vibrating surface. Such a patch has a self-adhesive quality and may be attached by contacting the vibrating surface. In one embodiment, the patch has a tapered edge that serves to improve the quality of the bond between the patch and the surface.

25 Claims, 3 Drawing Sheets

VISCOELASTIC POLYMER DAMPING FOR PERCUSSION INSTRUMENTS

CROSS-REFERENCE TO RELATED APPLICATIONS

The present application claims priority to U.S. Provisional Patent Application Ser. No. 60/719,648, which was filed on Sep. 22, 2005 by Jeffery J. Sharp and entitled "Viscoelastic Polymer Damping for Percussion Instruments".

BACKGROUND OF THE INVENTION

1. Field of the Invention

The present invention relates generally to percussion instruments and more specifically to damping a vibrating surface of a percussion instrument.

2. Background Information

Percussionists often desire to damp their musical instruments, for example drums, in order to control or change the sound emanating from the instruments. To better understand damping, it is useful to review how a drum produces a distinctive sound.

A drum is basically a tensioned membrane fixed over a resonating chamber, enclosed by a rigid shell, typically cylindrical in shape. The membrane (commonly referred to as the drumhead) is often made of biaxially-oriented polyethylene terephthalate polyester (commonly referred to by the trade name Mylar® registered to DuPont Teijin Films L.P.), though animal skins and other poly-spun fibers are also used. A drum's distinctive sound is actually a combination of two different sounds; "attack," which is the sound made by a drumstick or hand striking the drumhead, and "resonance," which is the sound produced by vibrations of a resonating chamber of the drum. When the drumhead is struck, vibrations of the drumhead are transmitted to the shell at a bearing edge where the drumhead meets the shell (often termed a counterhoop or rim). Also, movement of the drumhead causes air to impact the interior walls of the shell and a bottom membrane (bottomhead) of the drum. All these vibrations interact to produce a resonance.

Any modification of a vibrating surface of a percussion instrument generally affects the vibrations produced. For example, modification of a drumhead has a dramatic effect on a drum's sound. Accordingly, musicians have employed various techniques to change the sound of percussion instruments, often by attempting to damp the instruments.

For example, U.S. Pat. No. 4,745,839 discloses a damping structure that includes an inflatable balloon-like cushioning member that may be mounted inside a drum to contact with an interior face of the drumhead. The cushioning member is attached to a rod that spans the drum, holding it in place.

By way of further example, U.S. Pat. No. 5,637,819 discloses a self-adhesive gel patch that adheres to a vibrating percussion instrument surface. The gel in the gel patch is primarily composed of a PVC copolymer resin.

Yet, these and other existing techniques have been found unsatisfactory in practice. Damping systems disposed inside of a percussion instrument are often cumbersome to install and difficult to add or remove quickly, as often required during a musical performance. Further, assemblies disposed inside a percussion instrument have a tendency to produce rattles and other unpleasant sounds. Similarly, existing systems that damp by attaching to the exterior of a percussion instrument suffer a variety of shortcomings. Such systems typically use adhesives that may transfer to or soil the surface of the percussion instrument, or lose their adhesive properties over time. Even when new, such known adhesive based systems commonly do not adhere well, and due to a lack of adhesion, provide insufficient damping effect. Other systems may use colloidal suspensions or gels, yet these systems also often lose their adhesive properties over time. Further, devises employing colloidal suspensions or gels often do not feel responsive when struck and therefore limit a musician's options in performances.

SUMMARY OF THE INVENTION

A system and method are provided for damping a vibrating surface, such as a drumhead, of a percussion instrument by attaching a patch made of a viscoelastic urethane polymer, for example a low-Durometer urethane polymer, to an exterior face of the vibrating surface. Such a patch has a self-adhesive quality and may be attached to the vibrating surface simply by bringing it in contact with the surface. The self-adhesive quality may be renewed indefinitely by washing and air drying the patch. In one embodiment, the patch has a tapered edge that serves to improve the quality of the bond between the patch and the surface, as opposed to non-tapered configurations. Multiple viscoelastic damping systems may be attached to a percussion instrument, in a variety of configurations, to achieve the desired sound.

BRIEF DESCRIPTION OF THE DRAWINGS

The description below refers to the accompanying drawings, of which.

DETAILED DESCRIPTION OF AN ILLUSTRATIVE EMBODIMENT

Figure 1A:
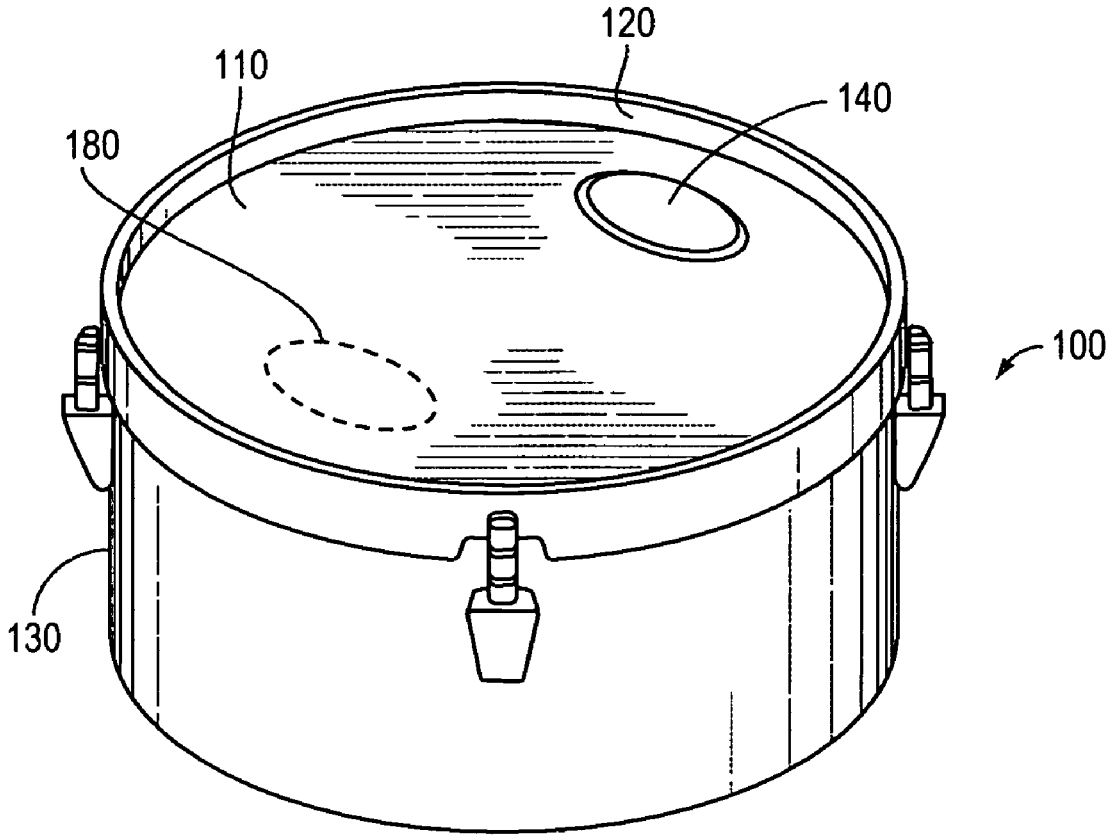
FIG. 1A is a perspective view of an illustrative embodiment of a viscoelastic damping system attached to a drum.

FIG. 1A is a perspective view of an illustrative embodiment of a viscoelastic damping system attached to a drum. While a drum 100 is pictured in FIG. 1A for exemplary purposes, the viscoelastic damping system is in no way limited this particular type of instrument. It is accordingly contemplated that the system may be used with a wide variety of percussion instruments, for example wood blocks, tambourines, cymbals, or other instruments. The drum 100 includes a drumhead 110 attached to a shell 130. The drumhead is held in place by a counterhoop 120, which may also be struck to produce various sounds.

A viscoelastic damping system 140 is shown adhered to the drumhead 110 in this illustrative embodiment. While the viscoelastic damping system 140 in shown adhered to the drumhead 110 proximate to the counterhoop 120, it may be positioned at other locations as determined by a musician's preferences. Further, the viscoelastic damping system may be used with a variety of other vibrating surfaces of percussion instruments, for example the bottomhead of a drum or a surface of a wood block. Accordingly, the description of drumhead 110 should be taken by way of example.

Figure 1B:
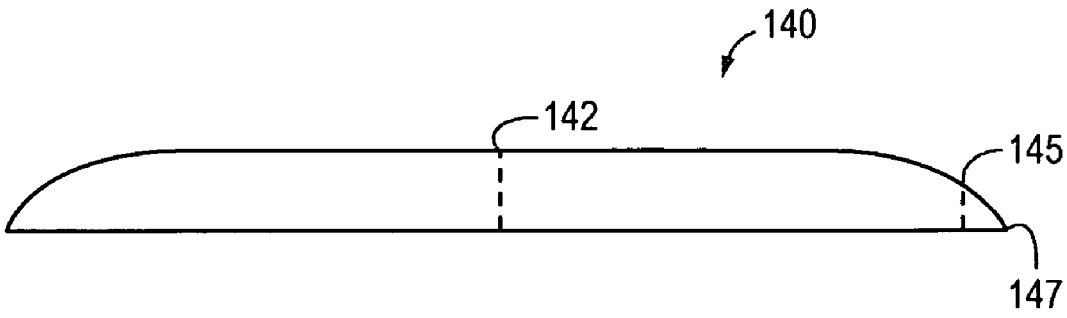
FIG. 1B is a cross-section view of an embodiment of a viscoelastic damping system including a tapered edge.

Referring now to FIG. 1B, in this illustrative embodiment the viscoelastic damping system is a patch of approximately circular shape, dimensioned approximately 100 millimeters in diameter and 4 millimeters in thickness at the center 142. In one embodiment, the thickness of the viscoelastic damping system tapers to approximately 2 millimeters at a radial location 145 proximate to the patch's edge, and then tapers further to the edge itself 147, such that the thickness of the viscoelastic damping system approaches zero very near the edge 147. As explained further below, this optional taper serves to enhance durability of the bond between the viscoelastic damping system and the surface to which it is adhered.

Depending on the size of the instrument, the amount of damping the musician desires, and other factors, it is contemplated that patches of various dimensions may be advantageously employed. It is also contemplated that other shapes may be employed, for example the viscoelastic damping system 140 may be a patch of approximately quadrilateral or elliptical shape. In one embodiment, the viscoelastic damping system 140 may be a patch shaped as ring, with a cut-away center area. One ring-shaped embodiment has an inner diameter of approximately 125 millimeters, an outer diameter of approximately 200 millimeters, and a thickness of approximately 2 to 3 millimeters. Such a ring-shaped embodiment may be employed to dampen cymbals or other instruments that require an open center region to accommodate structures of the instrument.

Further, one or more additional damping systems may be placed on a vibrating surface of the percussion instrument. For example, FIG. 1A depicts a second optional viscoelastic damping system 180 (shown in dotted lines) attached to the drumhead 110. Similarly, multiple viscoelastic damping systems may be employed to damp a cymbal or other instrument, for example by placing several of them in a ring-like arrangement on a vibrating surface of the instrument. Use of multiple viscoelastic damping systems increases and distributes the damping effect, and may further change the sound produced by an instrument in desirable manners.

The viscoelastic damping system 140 is constructed, at least partially, of a viscoelastic urethane polymer. Such material has been found to offer a number of properties desirable in damping percussion instruments. Viscoelastic urethane polymer possesses a self-adhesive property when brought into contact with a variety of surfaces. This self-adhesion is sufficient to affix the viscoelastic damping system to a percussion instrument without use of glues or other adhesives that may transfer to, or soil, the instrument. The self-adhesion has been found sufficient to retain the viscoelastic damping system in a vertical or inverted attitude, even when directly struck by a drumstick or hand. Further, viscoelastic urethane polymer's self-adhesive qualities may be renewed indefinitely by washing the material in water or in a mixture of water and mild detergent, and then air drying. In this way, the viscoelastic damping system may have an extended useful life.

Further, viscoelastic urethane polymer offers a more responsive feel when struck by a hand or drumstick, than conventional materials. Such responsiveness is desirable to musicians and enhances their musical performance. A smooth transition may be provided between the patch of viscoelastic urethane polymer and the vibrating surface of the percussion instrument to further improve feel for the musician. Accordingly, it is contemplated that the viscoelastic damping system may be rounded, tapered, or otherwise shaped to suit a musician's preferences.

Also, viscoelastic urethane polymer offers improved durability compared to conventional materials, and has a surface that is tear and abrasion resistant. This surface is suitable for printing and accordingly may be used for promotional and advertising purposes.

In one illustrative embodiment, the viscoelastic urethane polymer is low-Durometer urethane polymer. A low-Durometer urethane polymer is defined as a urethane having a hardness of less than 40 Shore A on the well-known Durometer A scale. A variety of known urethane polymers may be formulated to yield hardness in this range, with the ratio of components adjusted to achieve a precise hardness.

For example, in one embodiment of the viscoelastic dampening system, the system is constructed of Variable Hardness Polyurethane™ formulated to have 10 Shore A Durometer hardness. Variable Hardness Polyurethane™ is commercially available from Crosslink Technology Inc., and is constructed from a mixture of Diphenyl methane Diisocyanate (MDI) and polyglycol blends. The material further comprises 15-40% Dibutyl Phthalate and 15-40% Di-(Methyl-Thio)Toluenediamine.

Alternately, in another embodiment of the viscoelastic dampening system 140, the system is constructed of low-Durometer urethane of approximately 30 Shore A hardness comprising Toluenediisocyanate (TDI) polyester glycol prepolymer containing 45 parts per hundred of a phthalate plasticizer and 60 parts per hundred of a silica filler, combined with a multi functional glycol/catalyst blend. Accordingly, it is contemplated that the viscoelastic urethane polymer may be any of a number of low-Durometer urethanes.

Further, as discussed above, in one embodiment the viscoelastic damping system 140 has a tapered edge that serves to improve the quality of the bond between the viscoelastic damping system 140 and a vibrating surface. The viscoelastic damping system 140 tapers as it approaches its edge 147 (see FIG. 1B) such that the thickness of the viscoelastic damping system nears zero very close the edge 147. Such a taper may be provided by the viscoelastic damping system 140 having a curved cross-section, as shown in FIG. 1B. In one configuration, the cross-section has a convex meniscal shape 147, where the slope of the curvature increases as it approaches the edge 147. Such a convex meniscal shape is amenable to easy manufacture as it may be obtained by simply placing a quantity of liquid viscoelastic urethane polymer in a flat mold, and allowing surface tension of the polymer, and the surface resistance of the mold, to naturally shape the liquid to form a convex meniscus. In another configuration, the cross-section has a roughly parabolic shape, where the slope of the curvature decreases as it approaches the edge 147. In yet another alternate configuration, the cross section has an angular shape, composed of two or more approximately-straight segments arranged at angles.

A tapered design reduces forces on the edge 147 of the viscoelastic damping system 140 that contribute to adhesion failure. Generally an adhesive bond will fail at the edge of a bonded surface (i.e. the material will peel), as this failure mode requires less energy than a failure in the center of an adhesive bond. In the case of a viscoelastic damping system 140 attached to a vibrating surface, the damping system will generally be induced to peel at the edge in response momentum of the damping system resisting movements of a vibrating surface. That is, the viscoelastic damping system 140 has mass and thus force is required to induce movement in this mass. If this force is greater than the adhesive force holding the damping system to the vibrating surface, the damping system will peel. By tapering the edge of the viscoelastic damping system 140, its thickness, and thus its mass, approach zero near the edge 147. Thereby, the force due to momentum incident on the edge 147 is generally reduced below the threshold necessary for peel initiation.

Figure 2:
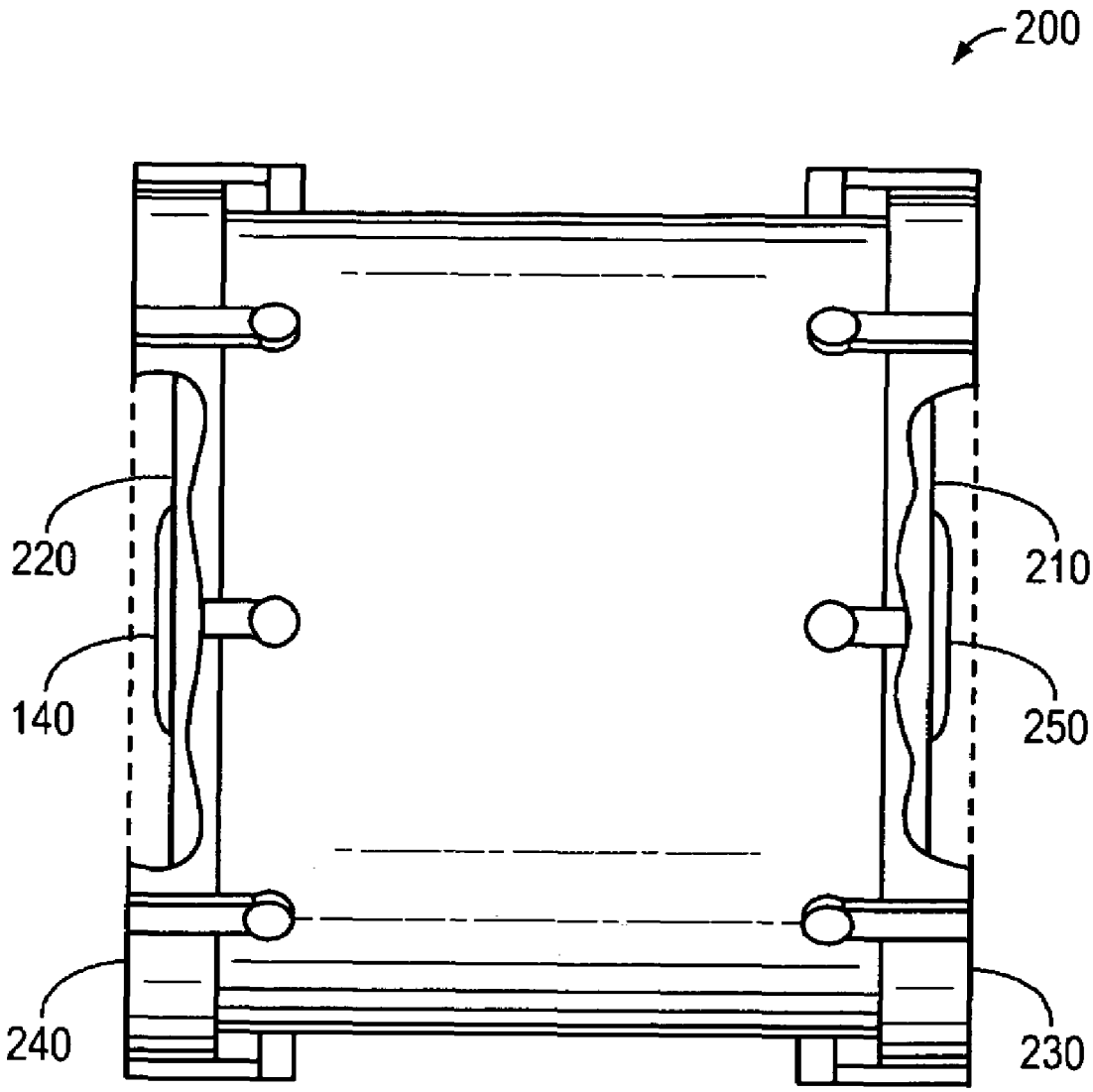
FIG. 2 is a side view of an illustrative embodiment showing a viscoelastic damping system attached to each drumhead of a two-headed drum.

FIG. 2 is a side view of an illustrative embodiment showing a viscoelastic damping system 140, 250 attached to each drumhead of a two-headed drum 200. It is contemplated that viscoelastic damping systems may be advantageously attached to one or more vibrating surfaces of percussion instruments with multiple vibrating surfaces. For example, the illustrative embodiment in FIG. 2 depicts a drum 200 having first and second drumheads 210, 220 surrounded by first and second counterhoops 230, 240. Viscoelastic damping systems 140, 250 are shown attached to these drumheads (visible in FIG. 2 in cut away regions). In this way, multiple viscoelastic damping system may be used according to a musician's personal preferences.

Figure 3:
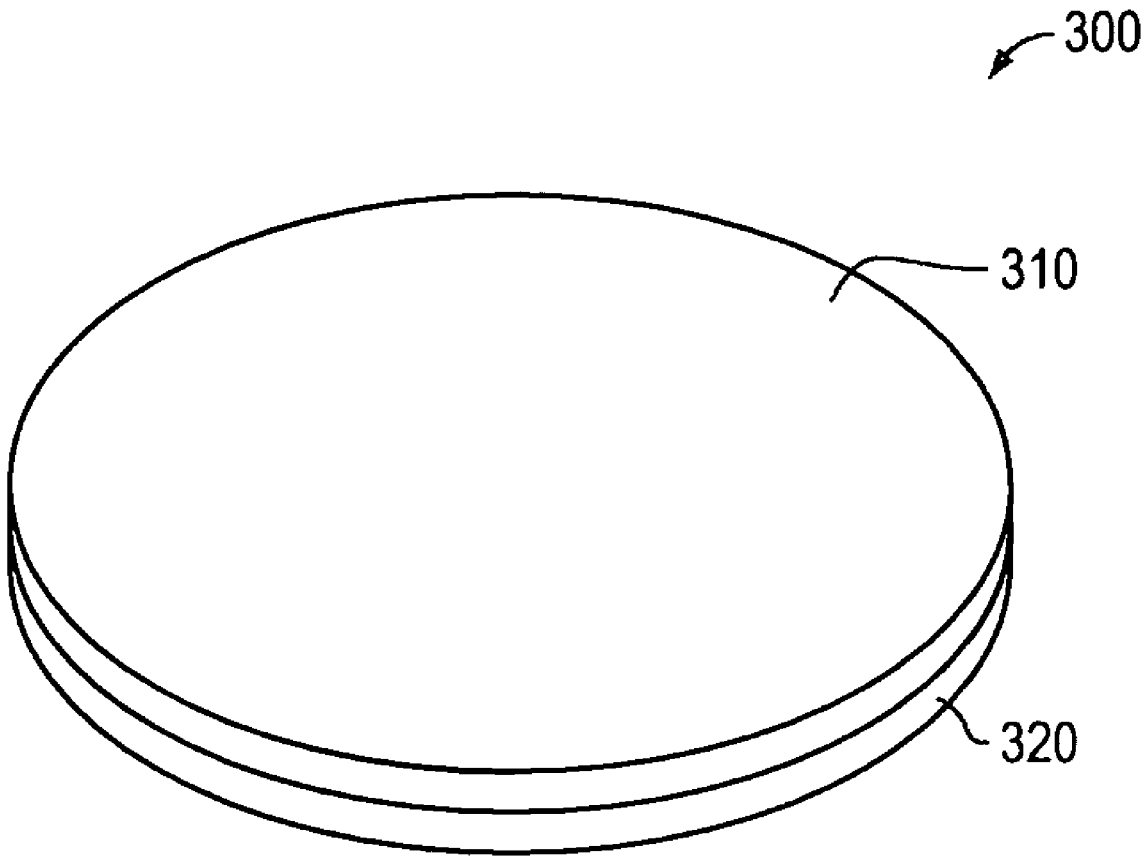
FIG. 3 is a perspective view of an illustrative embodiment of a viscoelastic damping practice pad 300

FIG. 3 is a perspective view of an illustrative embodiment of a viscoelastic damping practice pad 300. Practice pads are patches of material that simulate a drum's surface, allowing a musician to practice techniques, while not producing the sounds associated with an actual drum. The viscoelastic damping practice pad 300 has a striking surface 310 that provides a firm surface suitable for use with drumsticks, joined to a lower adhesive layer 320 that affixes the practice pad in place when contacted with a surface. In this illustrative embodiment, the practice pad is approximately circular in shape and is dimensioned approximately 200 millimeters in diameter and approximately 6 millimeters in thickness. The striking surface 310 is constructed of a visco-elastic urethane polymer of approximately 50 Shore A Durometer hardness, while the lower adhesive layer 320 is constructed of a viscoelastic urethane polymer of approximately 10 Shore A Durometer hardness. However, it is expressly contemplated that other shapes, dimensions, hardnesses, and configurations may be advantageously employed. For example, a single-layer practice pad may be constructed entirely of viscoelastic urethane polymer with approximately 10 Shore A Durometer hardness. Accordingly, the above illustrative embodiments of the damping practice pad should be taken by way of example.

The foregoing has been a detailed description of various illustrative embodiments of the present invention. Further modifications and additions can be made without departing from the invention's intended spirit and scope. It is expressly contemplated that other materials may be used in conjunction with the materials described above to implement the viscoelastic damping system. For example, a second material may be used along with the disclosed viscoelastic urethane polymer to change the amount of damping provided, the nature of the sound produced, or other properties of the system. Accordingly, it should be remembered that the above descriptions are meant to be taken only by way of example, and not to otherwise limit the scope of this invention.

What is claimed is:

1. A system for damping a vibrating surface of a percussion instrument comprising:

a patch constructed from at least a low-Durometer urethane, the patch configured to be attached to the vibrating surface of the percussion instrument, wherein the low-Durometer urethane has a self-adhesive quality such that the patch adheres when contacted with the vibrating surface absent use of glues or other adhesive.

2. The system of claim 1 wherein the patch is tapered such that a thickness of the patch decreases with proximity to an edge of the patch.

3. The system of claim 2 wherein the patch has a convex meniscal cross-section.

4. The system of claim 1 wherein the patch is configured to be attached to an exterior face of the vibrating surface.

5. The system of claim 1 wherein the patch is constructed from a low Durometer urethane having approximately 10 shore A hardness.

6. The system of claim 1 wherein the patch is circular in shape.

7. The system of claim 6 wherein the patch has a diameter of approximately 100 millimeters and a thickness of approximately 4 millimeters at a center.

8. The system of claim 1 wherein the percussion instrument is a drum and the vibrating surface is a drumhead.

9. A method for damping one or more vibrating surfaces of a percussion instrument comprising the step of:

attaching a patch constructed from at least a low-Durometer urethane to a first vibrating surface of the percussion instrument, wherein the low-Durometer urethane has a self-adhesive quality such that the patch adheres when contacted with the vibrating surface absent use of glues or other adhesive.

10. The method of claim 9 further comprising the step of:

attaching a second patch constructed from at least a low-Durometer urethane to a second vibrating surface of the percussion instrument.

11. The method of claim 9 further comprising the step of:

attaching a second patch constructed from at least a low-Durometer urethane to the first vibrating surface of the percussion instrument.

12. The method of claim 9 further comprising the step of:

washing the patch to renew the self-adhesive quality of the patch.

13. The method of claim 9 wherein the patch is tapered such that a thickness of the patch decreases with proximity to an edge of the patch.

14. The method of claim 13 wherein the patch has a convex meniscal cross-section.

15. A damped percussion instrument comprising:

a vibrating surface; and a patch constructed from at least a low-Durometer urethane attached to the vibrating surface, the patch configured to damp vibrations of the vibrating surface, wherein the low-Durometer urethane has a self-adhesive quality such that the patch adheres when contacted with the vibrating surface absent use of glues or other adhesive.

16. The damped percussion instrument of claim 15 wherein the patch is tapered such that a thickness of the patch decreases with proximity to an edge of the patch.

17. The damped percussion instrument of claim 15 wherein the patch has a convex meniscal cross-section.

18. The damped percussion instrument of claim 15, wherein the vibrating surface is a drumhead.

19. A damped practice pad for practicing a percussion instrument comprising:

a striking layer constructed from a first viscoelastic urethane polymer;

an adhesive layer constructed from a second viscoelastic urethane polymer, the second viscoelastic urethane polymer having a hardness less than the first viscoelastic urethane polymer, the adhesive layer having a self-adhesive quality such that it adheres when contacted with a surface.

20. The damped practice pad of claim 19 wherein the first viscoelastic urethane polymer has at least 50 Shore A Durometer hardness.

21. The damped practice pad of claim 20 wherein the second viscoelastic urethane polymer has no more than 40 Shore A Durometer hardness.

22. The system of claim 1 wherein the patch is ring-shaped having an open center area.

23. The method of claim 9 wherein the patch is ring-shaped having an open center area.

24. The method of claim 12 wherein the washing of the patch is in a liquid that comprises water.

25. The damped percussion instrument of claim 15 wherein the patch is ring-shaped having an open center area.

* * * * *